US009289667B2

(12) United States Patent
Niskanen

(10) Patent No.: US 9,289,667 B2
(45) Date of Patent: Mar. 22, 2016

(54) HOCKEY PRACTICE SYSTEM

(71) Applicant: Eric J. Niskanen, Bemidji, MN (US)

(72) Inventor: Eric J. Niskanen, Bemidji, MN (US)

( * ) Notice: Subject to any disclaimer, the term of this patent is extended or adjusted under 35 U.S.C. 154(b) by 0 days.

(21) Appl. No.: 14/492,259

(22) Filed: Sep. 22, 2014

(65) Prior Publication Data

US 2015/0094171 A1 Apr. 2, 2015

Related U.S. Application Data

(60) Provisional application No. 61/883,695, filed on Sep. 27, 2013.

(51) Int. Cl.
*A63B 69/00* (2006.01)
*A63B 71/06* (2006.01)

(52) U.S. Cl.
CPC ..... *A63B 69/0026* (2013.01); *A63B 71/06* (2013.01); *A63B 2071/0602* (2013.01); *A63B 2209/08* (2013.01); *A63B 2209/10* (2013.01); *A63B 2220/806* (2013.01)

(58) Field of Classification Search
CPC ..... A63B 69/0024; A63B 69/0026; A63B 69/0086; A63B 69/0088; A63B 69/0079; A63B 69/3647; A63B 71/06
USPC ..... 473/422, 446, 563, 431, 212, 215, 229, 473/478, 425, 575; D30/153; D26/38; 119/796
See application file for complete search history.

(56) References Cited

U.S. PATENT DOCUMENTS 2,455,707 A * 12/1948 Sheffer ..... A63B 69/3647 473/229
3,738,661 A * 6/1973 Moller ..... A63B 21/015 473/229
4,023,797 A 5/1977 Sarrasin
4,111,419 A 9/1978 Pellegrino
4,229,002 A * 10/1980 Masters ..... A63B 21/06 473/229
4,253,663 A * 3/1981 Hughes ..... A63B 21/04 482/127
4,749,189 A * 6/1988 Frank ..... A63B 21/023 482/129
5,120,055 A 6/1992 McCarthy
5,524,893 A * 6/1996 McGinnis ..... A63B 21/04 473/229
5,584,481 A 12/1996 Caluori
5,688,197 A 11/1997 Peeters
5,816,945 A * 10/1998 Todd ..... A63B 69/0079 473/425

(Continued)

*Primary Examiner* — Mitra Aryanpour
(74) *Attorney, Agent, or Firm* — Neustel Law Offices; Jason L. Gilbert

(57) ABSTRACT

A hockey practice system for helping goaltenders and shooters to visualize scoring and goaltending angles in hockey. The hockey practice system generally includes a housing which houses an internal reel assembly. A plurality of reels within the housing include a plurality of cords which extend out of the front end of the housing to be magnetically secured to goalposts with a plurality of anchors. The rear end of the housing includes a blade sleeve into which the blade of a hockey stick may be inserted and retained. As the housing is moved with the hockey blade, the cords will define an area in which a puck would travel if shot. A camera on the front of the housing may also be included to record practice for future reference.

20 Claims, 12 Drawing Sheets

(56) References Cited

U.S. PATENT DOCUMENTS

| | | | | |
|---|---|---|---|---|
| 6,716,120 | B1 | 4/2004 | Normand | |
| 6,918,845 | B2 * | 7/2005 | Kudla | A63B 24/0021 473/478 |
| 7,207,296 | B2 * | 4/2007 | DiDonato | A01K 27/004 119/794 |
| 7,364,516 | B2 * | 4/2008 | Kim | A63B 21/0552 473/229 |
| 7,980,202 | B2 * | 7/2011 | Bentz | A01K 27/004 119/796 |
| 7,997,993 | B1 * | 8/2011 | Matthews | A63B 21/0442 473/229 |
| 9,107,394 | B2 * | 8/2015 | Geller | A01K 27/004 119/796 |
| 2009/0120376 | A1 * | 5/2009 | Foster | A01K 27/003 119/795 |
| 2010/0240476 | A1 * | 9/2010 | Des Roches | A63B 69/0024 473/446 |
| 2011/0067649 | A1 * | 3/2011 | O'Brien | A01K 27/004 119/796 |
| 2012/0255218 | A1 * | 10/2012 | Haroian | A01K 97/06 43/54.1 |
| 2015/0094171 | A1 * | 4/2015 | Niskanen | A63B 69/0026 473/446 |

* cited by examiner

HOCKEY PRACTICE SYSTEM

CROSS REFERENCE TO RELATED APPLICATIONS

I hereby claim benefit under Title 35, United States Code, Section 119(e) of U.S. provisional patent application Ser. No. 61/883,695 filed Sep. 27, 2013. The 61/883,695 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a hockey aid and more specifically it relates to a hockey practice system for helping goaltenders and shooters to visualize scoring and goaltending angles in hockey.

2. Description of the Related Art

Any discussion of the related art throughout the specification should in no way be considered as an admission that such related art is widely known or forms part of common general knowledge in the field.

Hockey remains popular throughout the world. Youths and adults alike have embraced the sport both on ice and other surfaces. In all areas, there is a desire to improve goaltending and shooting as they are fundamental skills for any hockey player whether amateur or veteran. While setting up scrimmages or shoot-offs can aid in improvement of these skills, it is still difficult to visualize exact paths of travel for the puck without shooting over and over. Existing hockey aids for shooting are not interchangeable and can be difficult to install, maintain, or use.

Because of the inherent problems with the related art, there is a need for a new and improved hockey practice system for helping goaltenders and shooters to visualize scoring and goaltending angles in hockey.

BRIEF SUMMARY OF THE INVENTION

The invention generally relates to a hockey practice aid which includes a housing which houses an internal reel assembly. A plurality of reels within the housing include a plurality of cords which extend out of the front end of the housing to be magnetically secured to goalposts with a plurality of anchors. The rear end of the housing includes a blade sleeve into which the blade of a hockey stick may be inserted and retained. As the housing is moved with the hockey blade, the cords will define an area in which a puck would travel if shot. A camera on the front of the housing may also be included to record practice for future reference.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
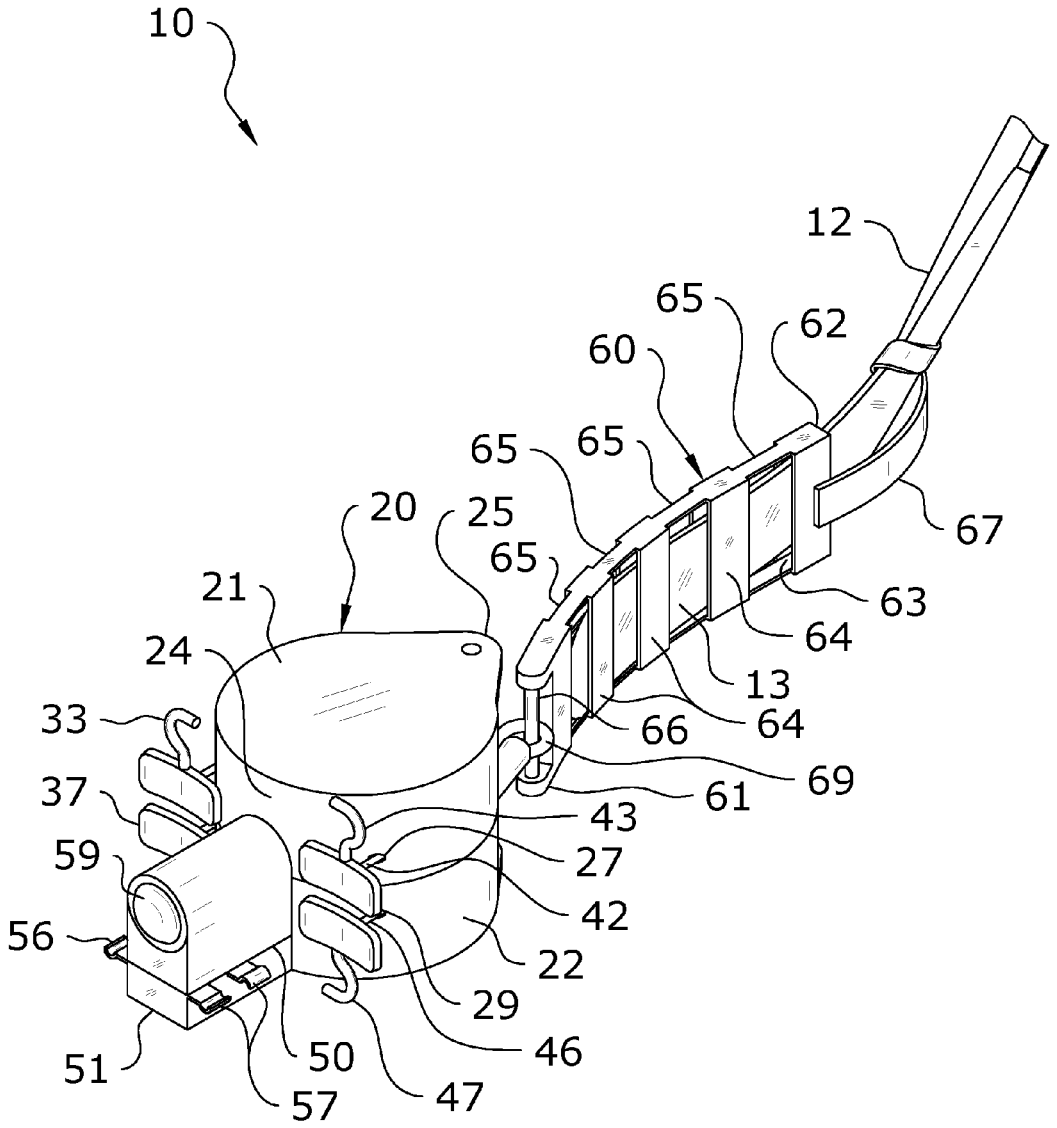
FIG. 1 is an upper perspective view of the present invention mounted on a hockey stick.

A. Overview.

Turning now descriptively to the drawings, in which similar reference characters denote similar elements throughout the several views, FIGS. 1 through 13 illustrate a hockey practice system 10, which comprises a housing 20 which houses an internal reel assembly. A plurality of reels 30, 34, 40, 44 within the housing 20 include a plurality of cords 32, 36, 42, 46 which extend out of the front end 24 of the housing 20 to be magnetically secured to goalposts 16, 17 with a plurality of anchors 33, 37, 43, 47. The rear end 25 of the housing 20 includes a blade sleeve 60 into which the blade 13 of a hockey stick 12 may be inserted and retained. As the housing 20 is moved with the hockey blade 13, the cords 32, 36, 42, 46 will define an area in which a puck would travel if shot. A camera 59 on the front of the housing 20 may also be included to record practice for future reference.

B. Puck Housing.

The present invention generally includes a housing 20 which stores the reel assembly of the present invention. The housing 20 will preferably be puck-shaped as shown throughout the figures, though it should be appreciated that other variations on the configuration of the housing 20 may be utilized. The shape, size, and configuration of the housing 20 may vary greatly between different applications and skillsets.

Figure 4:
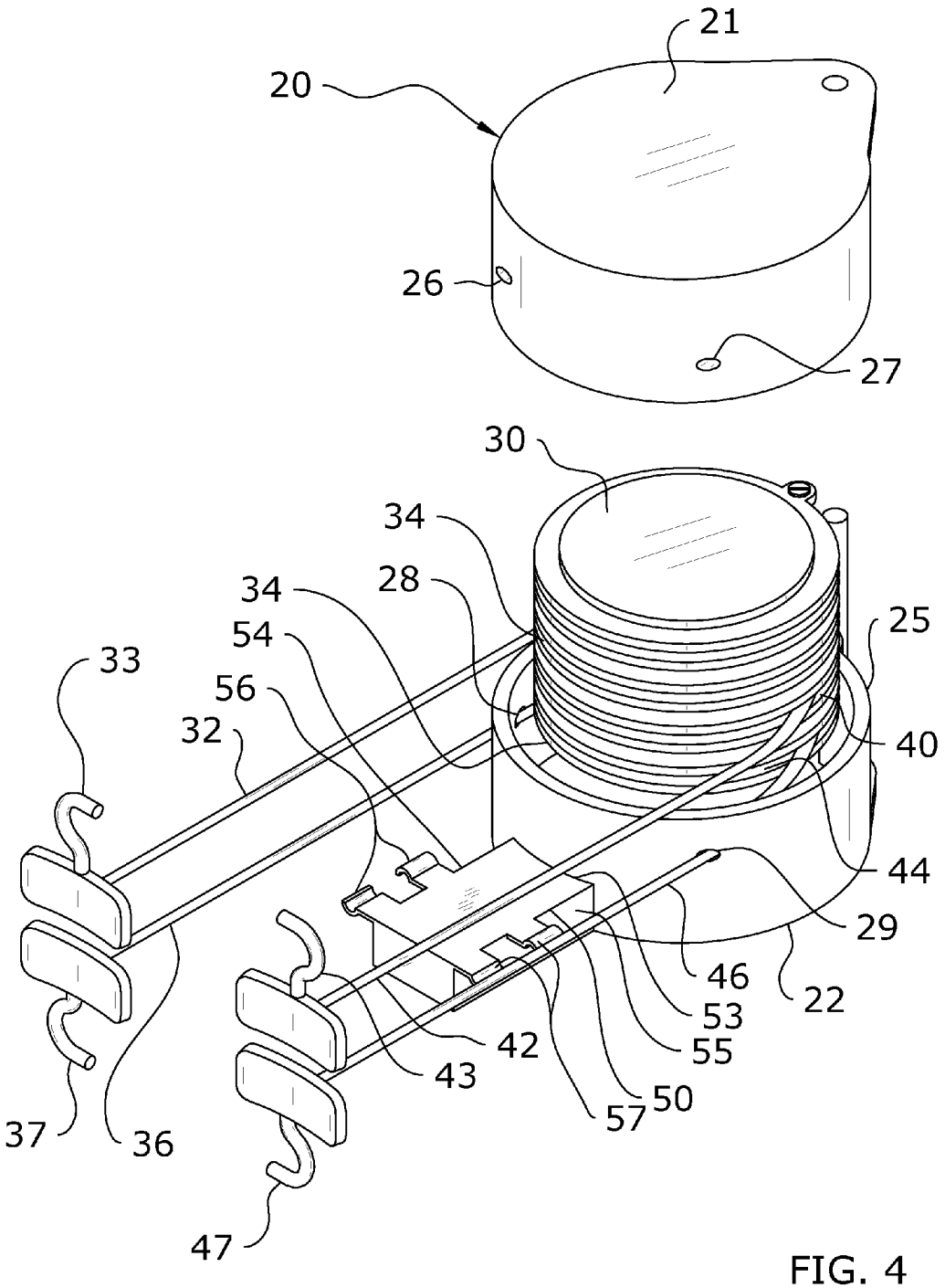
FIG. 4 is an upper perspective view of the housing with the first and second portions being separated.
Figure 5:
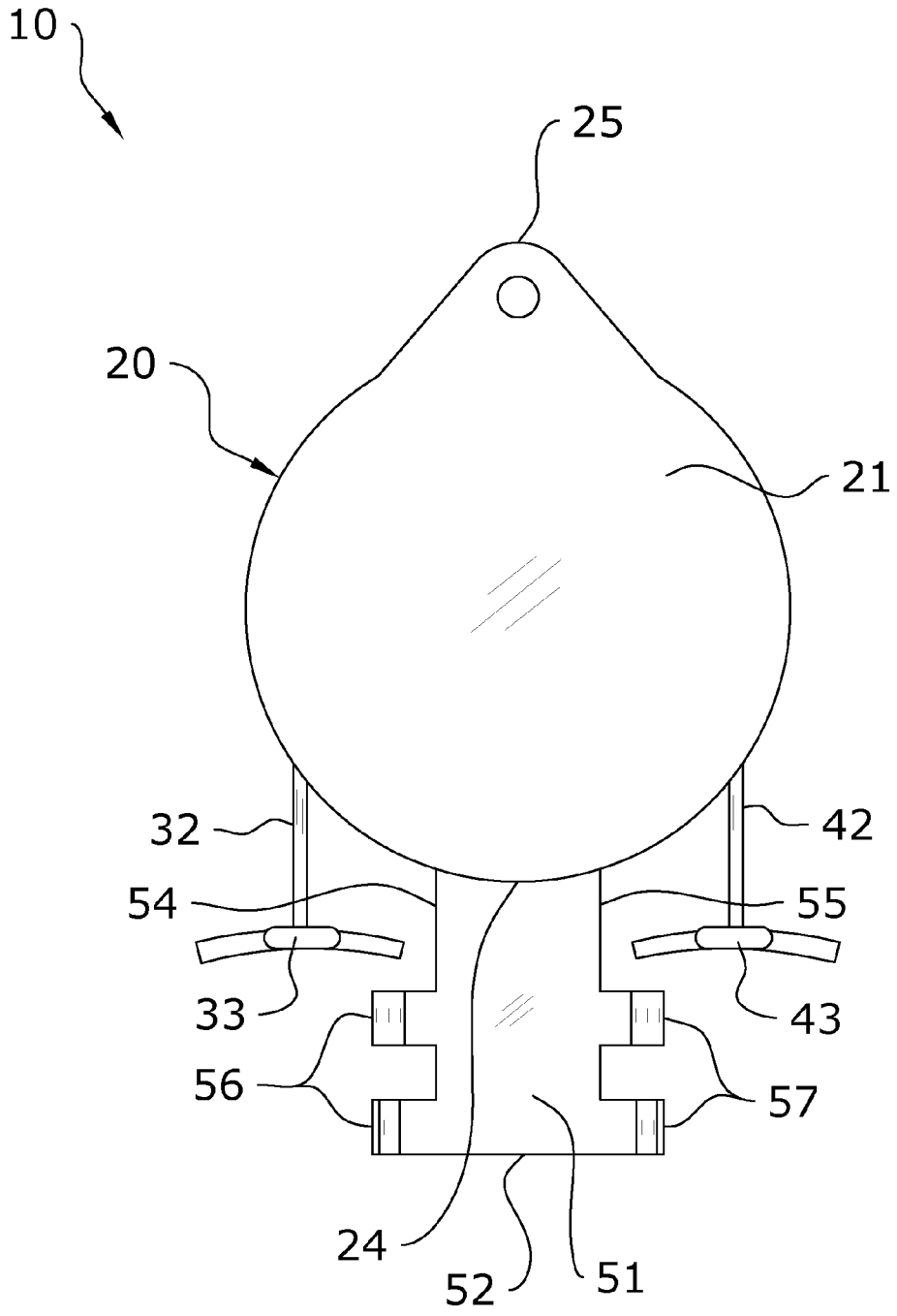
FIG. 5 is a top view of the housing of the present invention.
Figure 6:
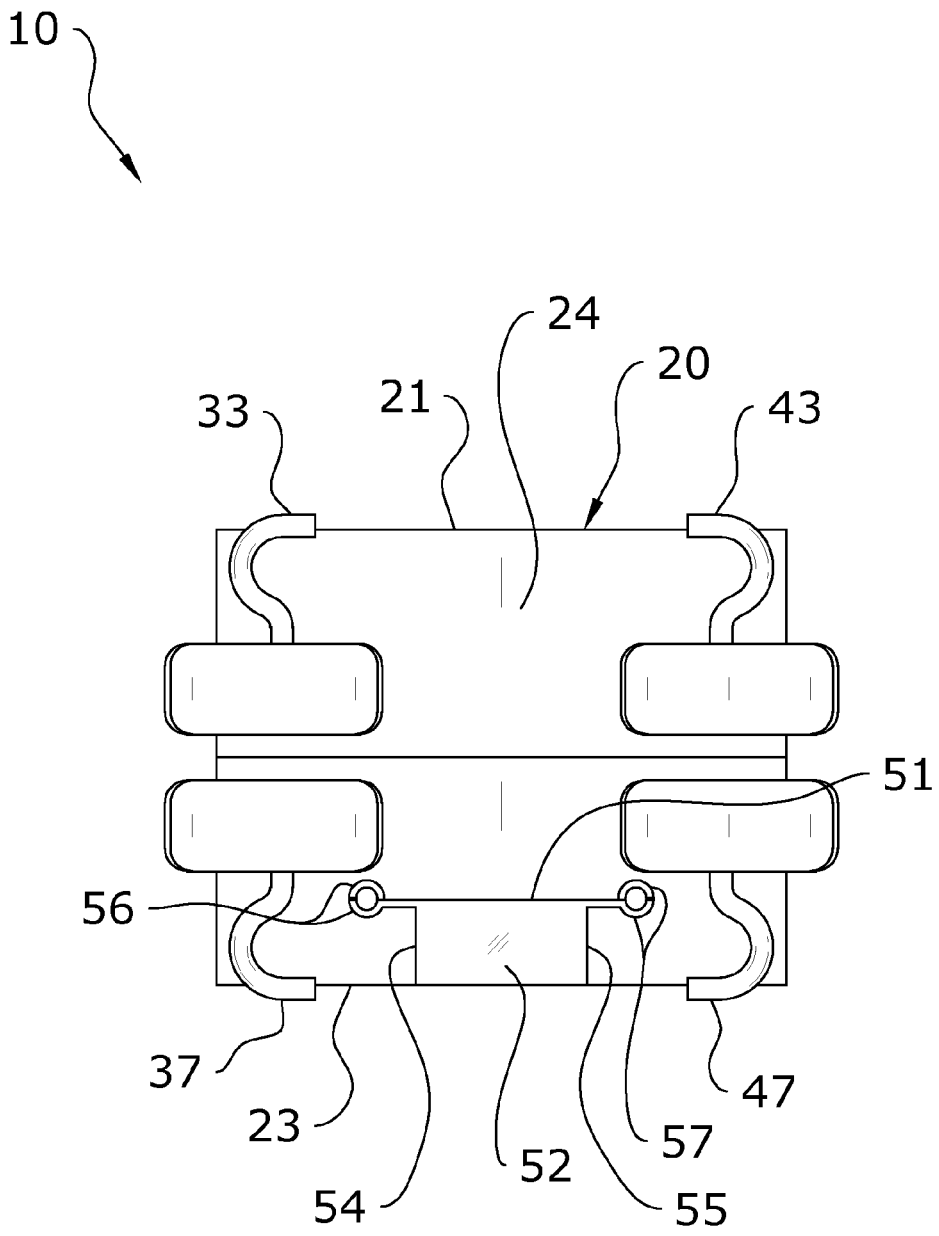
FIG. 6 is a frontal view of the housing of the present invention.
Figure 7:
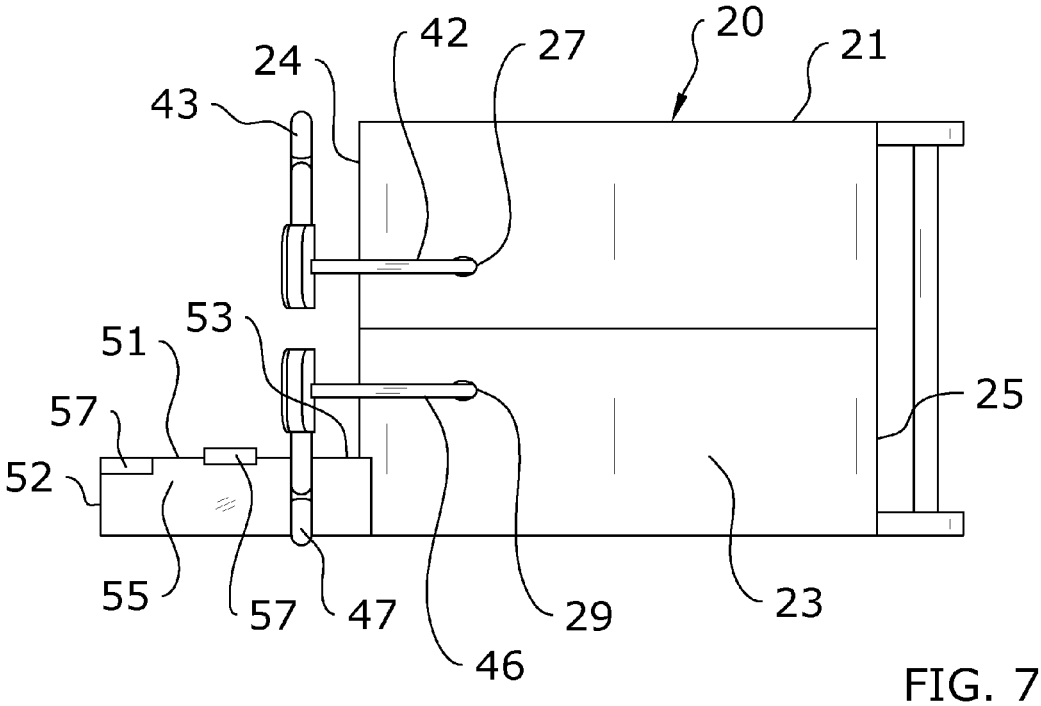
FIG. 7 is a first side view of the housing of the present invention.
Figure 8:
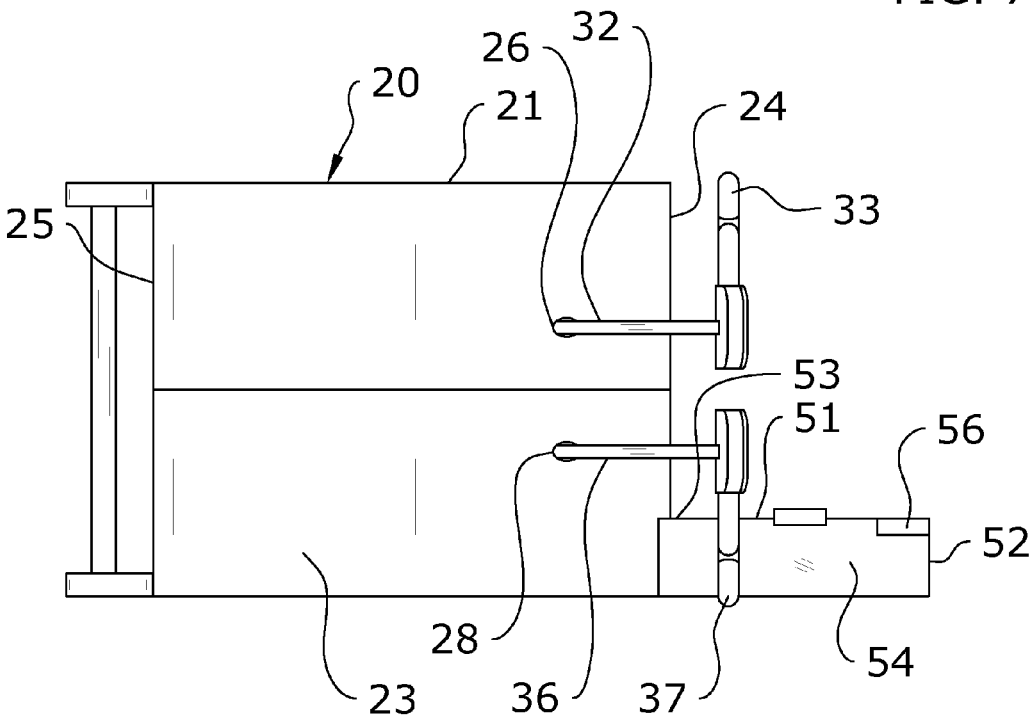
FIG. 8 is a second side view of the housing of the present invention.

Although the housing 20 may comprise a unitary, integral structure, a preferred embodiment utilizes two interconnecting portions 21, 22 as best shown in FIG. 4. The use of removably interconnected portions 21, 22 allows access to the internal reel assembly for maintenance, repair, or replacement. The first and second portions 21, 22 of the housing 20, when interconnected, define an internal compartment 23 in which the reel assembly of the present invention is stored and out of which the cords 32, 36, 42, 46 of the present invention extend.

Preferably, a first portion 21 of the housing 20 will be removably connected to a second portion 22 of the housing 20, such as through frictional engagement, fasteners, adhesives, or the like. As shown throughout the figures, a preferred embodiment includes an upper first portion 21 and a lower second portion 22, though other configurations may be utilized.

The housing 20 includes a front end 24 and a rear end 25. The cords 32, 36, 42, 46 of the present invention extend out of the front end 24 of the housing 20 to be anchored on goalposts 16, 17 as discussed herein. The housing 20 may thus include a plurality of openings 26, 27, 28, 29 out of which the cords 32, 36, 42, 46 of the present invention extend. The numbering, position, and configuration of the openings 26, 27, 28, 29 may vary in different embodiments of the present invention. In some embodiments, a single slot or other type of opening may be utilized.

Figure 9:
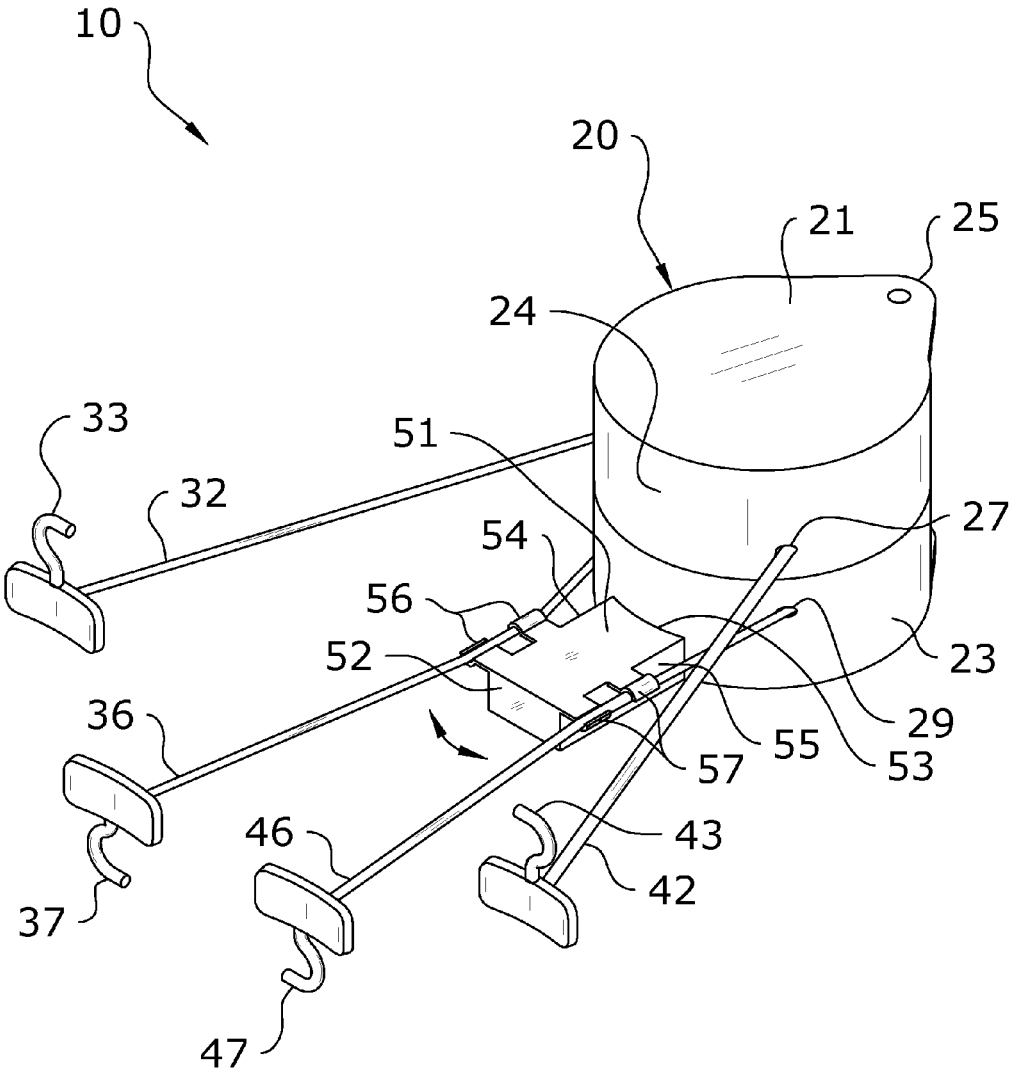
FIG. 9 is an upper perspective view of the housing with the cords being partially extended.
Figure 10:
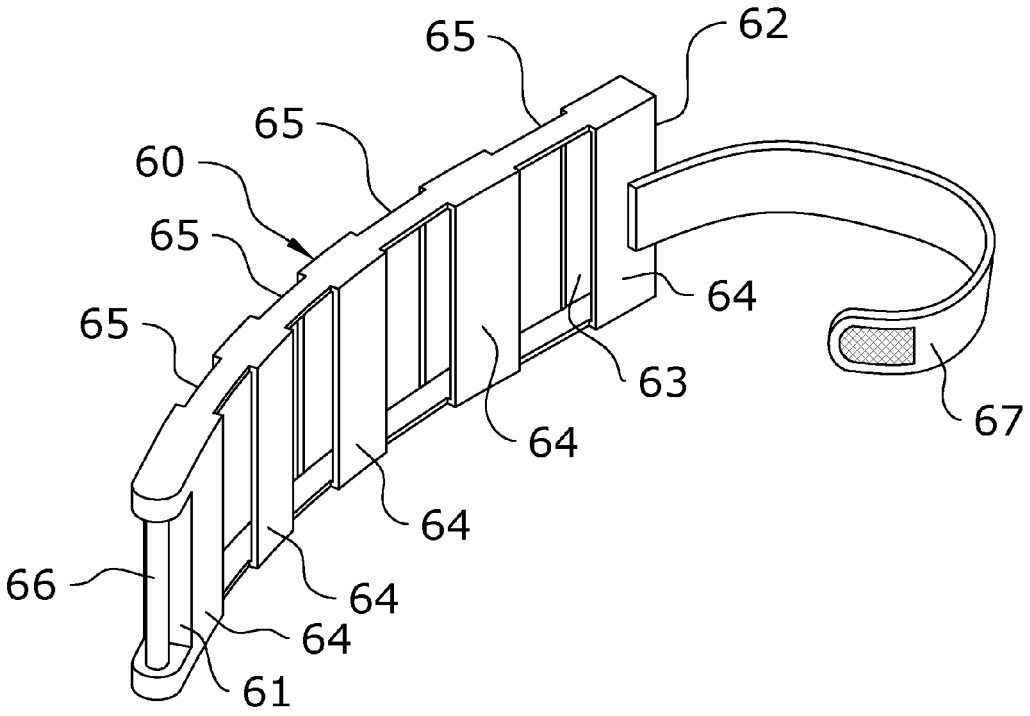
FIG. 10 is an upper perspective view of a blade sleeve for use with the present invention.

In a preferred embodiment as best shown in FIG. 9, the first portion 21 of the housing 20 includes a first upper opening 26 out of which the first cord 32 extends and a second upper opening 27 out of which the second cord 36 extends. Similarly, the second portion 22 includes a first lower opening 28 for the third cord 42 and a second lower opening 29 for the fourth cord 46.

The rear end 25 of the housing 20 may include an anchor 69 such as a loop, hook, or other structure to which the blade sleeve 60 may be easily connected. In some embodiments, a discrete anchor 69 may be omitted, with the blade sleeve 60 being integrally formed with the housing 20.

C. Reel Assembly.

The present invention includes a reel assembly which allows the cords 32, 36, 42, 46 to be extended or retracted to/from the housing 20. Generally, the reel assembly a plurality of reels 30, 34, 40, 44 around which are a plurality of cords 32, 36, 42, 46 which extend out of the housing 20 through its openings 26, 27, 28, 29. It should be appreciated that the exemplary figures and description herein merely describe one embodiment of the reel assembly. Thus, the numbering and positioning of reels 30, 44, 40, 44 and cords 32, 36, 42, 46 may vary in different embodiments of the present invention.

As best shown in FIG. 4, a plurality of reels 30, 34, 40, 44 are rotatably positioned within the internal compartment 23 of the housing 20. In the embodiment shown in the figures, the reels 30, 34, 40, 44 are stacked vertically within the housing 20, though other arrangements may be utilized. In the preferred embodiment shown in FIG. 4, a first reel 30, a second reel 34, a third reel 40, and a fourth reel 44 are vertically stacked within the housing 20. The first and third reels 30, 40 are adapted to rotate in a first direction when being unwound while the second and fourth reels 34, 44 are adapted to rotate in a second, opposite direction when being unwound with respect to the first and third reels 30, 40. Thus, the rotation of the reels 30, 34, 40, 44 is staggered.

As shown in the figures, each of the reels 30, 34, 40, 44 includes a cord 32, 36, 42, 46 wound therearound. In a preferred embodiment as shown in the figures, a first cord 32 is wound around the first reel 30, a second cord 36 is wound around the second reel 34, a third cord 42 is wound around the third reel 44, and a fourth cord 46 is wound around the fourth reel 44. Each of the cords 32, 36, 42, 46 retractably extends out of the respective openings 26, 27, 28, 29 of the housing 20.

Each of the cords 32, 36, 42, 46 is adapted to be removably secured to a goalpost 16, 17 on a goal 15. Thus, each cord 32, 36, 42, 46 may include a corresponding anchor 33, 37, 43, 47. As shown in FIG. 4, the first upper cord 30 may include a first upper anchor 33, the first lower cord 36 may include a first lower anchor 37, the second upper cord 42 may include a second upper anchor 43, and the second lower cord 46 may include a second lower anchor 47.

The anchors 33, 37, 43, 47 of the present invention, when included, may comprise various shapes, sizes, and configurations. In the exemplary figures, the anchors 33, 37, 43, 47 each comprise magnets positioned on the distal ends of the respective cords 32, 36, 42, 46. The anchors 33, 37, 43, 47 thus may be magnetically secured to the goalposts 16, 17. Any anchor configuration which allows the cords 32, 36, 42, 46 to be easily secured to and/or removed from goalposts 16, 17 may be utilized.

D. Camera.

Figure 2:
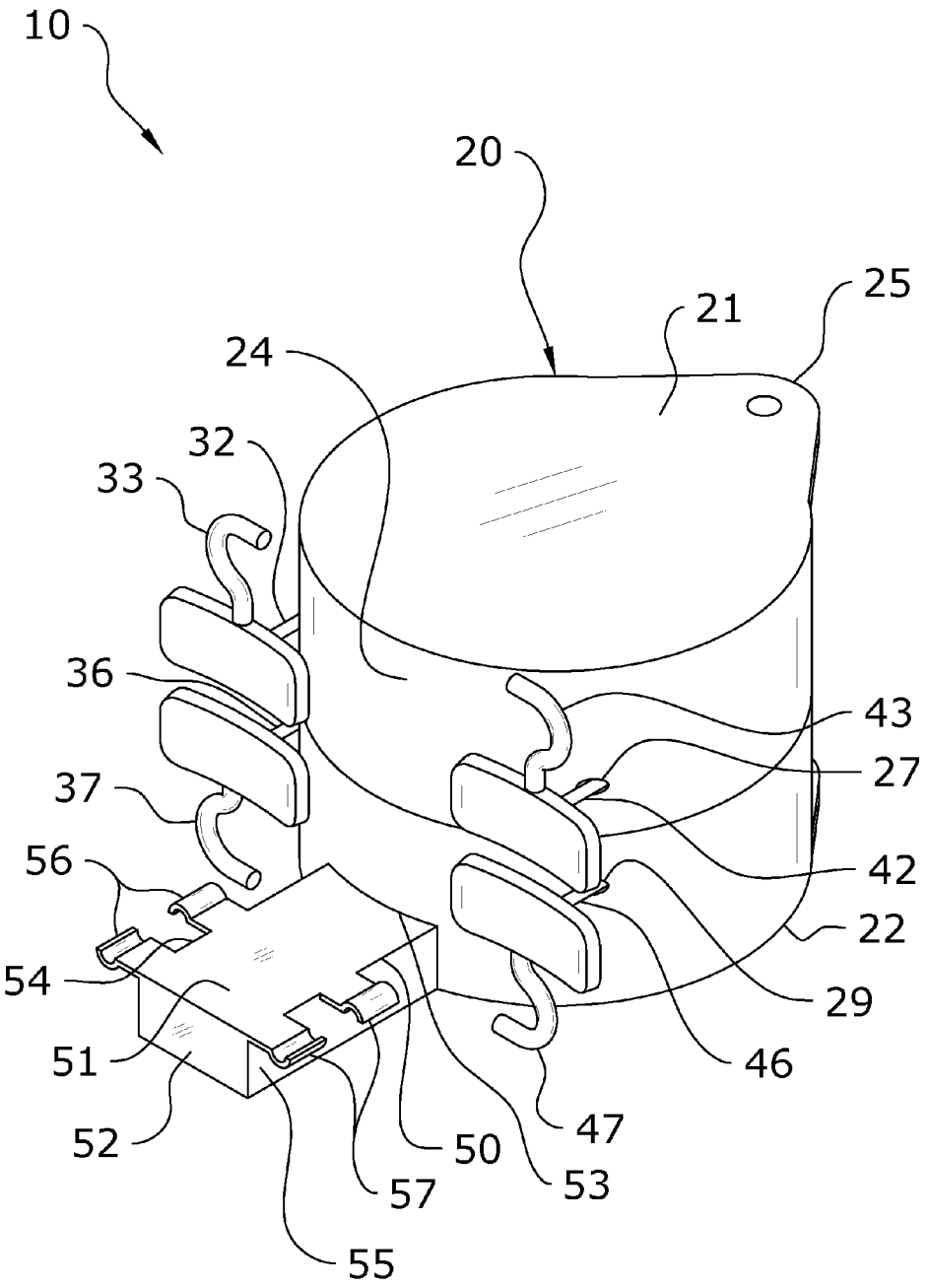
FIG. 2 is a frontal upper perspective view of the housing of the present invention.
Figure 3:
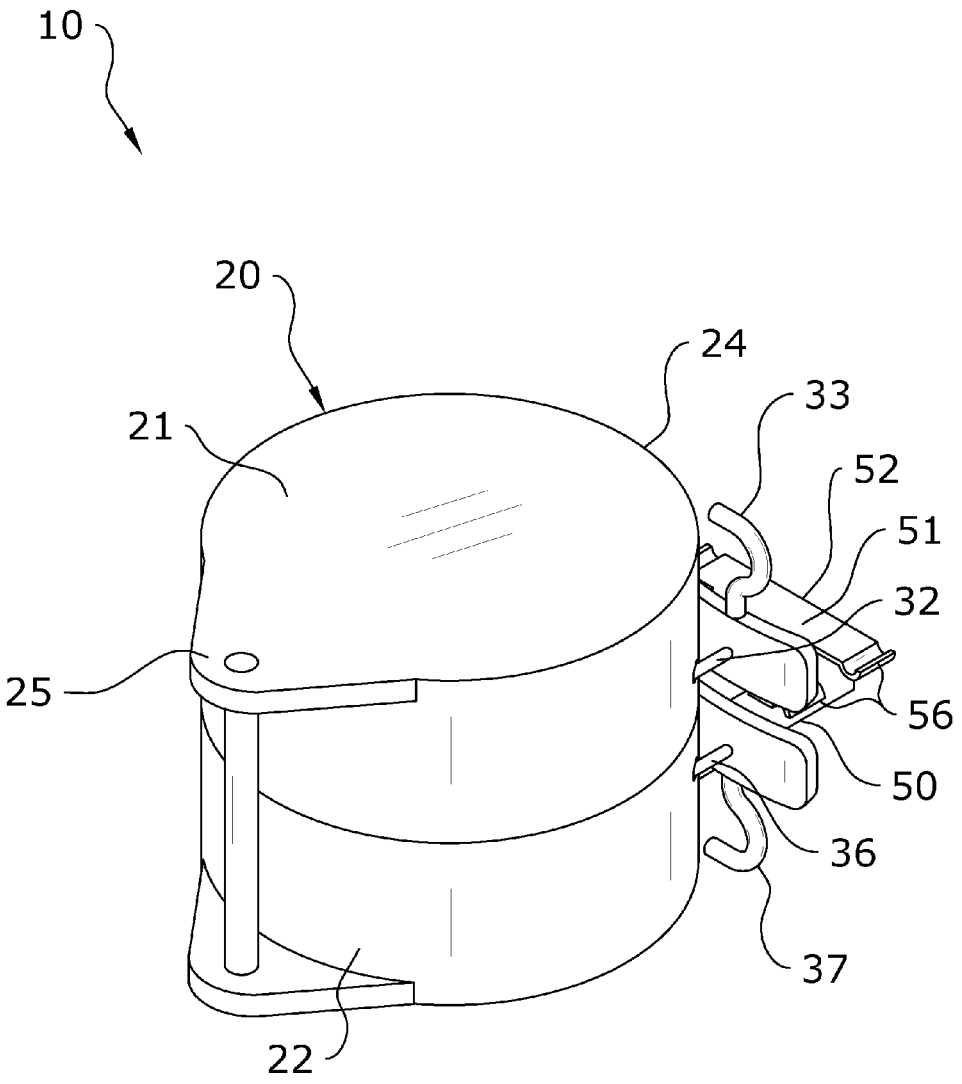
FIG. 3 is a rear upper perspective view of the housing of the present invention.

As best shown in FIG. 2, a camera mount 50 may extend from the front end 24 of the housing 20. The camera mount 50 generally comprises a base 51 which includes a front end 52 and a rear end 53. The rear end 53 of the base 51 is secured to the front end 24 of the housing 20 so as to freely swivel parallel with the horizontal ground plane. This swiveling motion of the base 51 allows the camera 59 of the present invention to follow the likely direction of travel of a puck after being shot.

To guide the swiveling motion of the camera mount 50, one or more first side retainers 56 extend from a first side 54 of the base 51 and one or more second side retainers 57 extend from a second side 55 of the base 51. In the embodiment shown in the figures, the first lower cord 36 is fed through the first side retainers 56 and the second lower cord 46 is fed through the second side retainers 57. Thus, the lower cords 36, 46 will cause the camera mount 50 to swivel along with motion of the pucks likely path if shot.

The camera mount 50 will generally include a camera 59 which is fixedly or removably secured to the base 51. Various types of cameras 59 may be utilized, though the camera 59 will preferably be adapted to record and/or transmit video. The camera 59 utilized should preferably be durable enough to survive usage in a hockey environment, such as exposure to ice, water, and repeated impact with other objects.

E. Blade Sleeve.

The rear end 25 of the housing 20 includes a rotatably secured blade sleeve 60 which is either fixedly attached, removably attached, or integrally formed with the housing 20. The blade sleeve 60 is adapted to fit around the blade 13 of a hockey stick 12 as shown in FIG. 1. The front end 61 of the blade sleeve 60 is hingedly or rotatably secured to the rear end 25 of the housing 20, such as by an anchor 69. The rear end 62 of the blade sleeve 60 may include a strap 67 for securing around the blade 13.

The blade sleeve 60 will generally include an inner slot 63 into which the blade 13 of the hockey stick 12 may be inserted. The blade sleeve 60 may vary in size, configuration, and shape to accommodate a wide variety of hockey sticks 12. The blade sleeve 60 may include a plurality of ribs 64 which define the sleeve 60 and which are each linked by linkages 65. The linkages 65 will preferably movably secure the ribs 64 so that the blade sleeve 60 may contort its shape around a blade 13 as shown in FIG. 1.

The front end 61 of the blade sleeve 60 may include a mount portion 66 which is connected to the anchor 69 of the housing 20. The mount portion 66 may comprise of elongated rod or other member which may be fit within the loop, hook, or other receiver of the anchor 69. As discussed previously, the rear end 62 of the blade sleeve 60 may include a strap 67 which may be secured around the hockey stick 12 to ensure that the blade 13 does not slide out of the blade sleeve 60.

F. Operation of Preferred Embodiment.

In use, the blade 13 of the hockey stick 12 is first inserted within the inner slot 63 of the blade sleeve 60 as shown in FIG. 1. The strap 67 is wrapped and secured around the hockey stick 12 to ensure that the blade 13 does not slide out of the blade sleeve 60. The camera 59 may also be secured to the camera mount 50 if not previously set up.

The cords 32, 36, 42, 46 may now be secured to the goalposts 16, 17 using the anchor 33, 36, 43, 46. The first upper and lower anchors 33, 37 will be magnetically secured to a first goalpost 16 and the second upper and lower anchors 43, 47 will be magnetically secured to a second goalpost 17.

Figure 11:
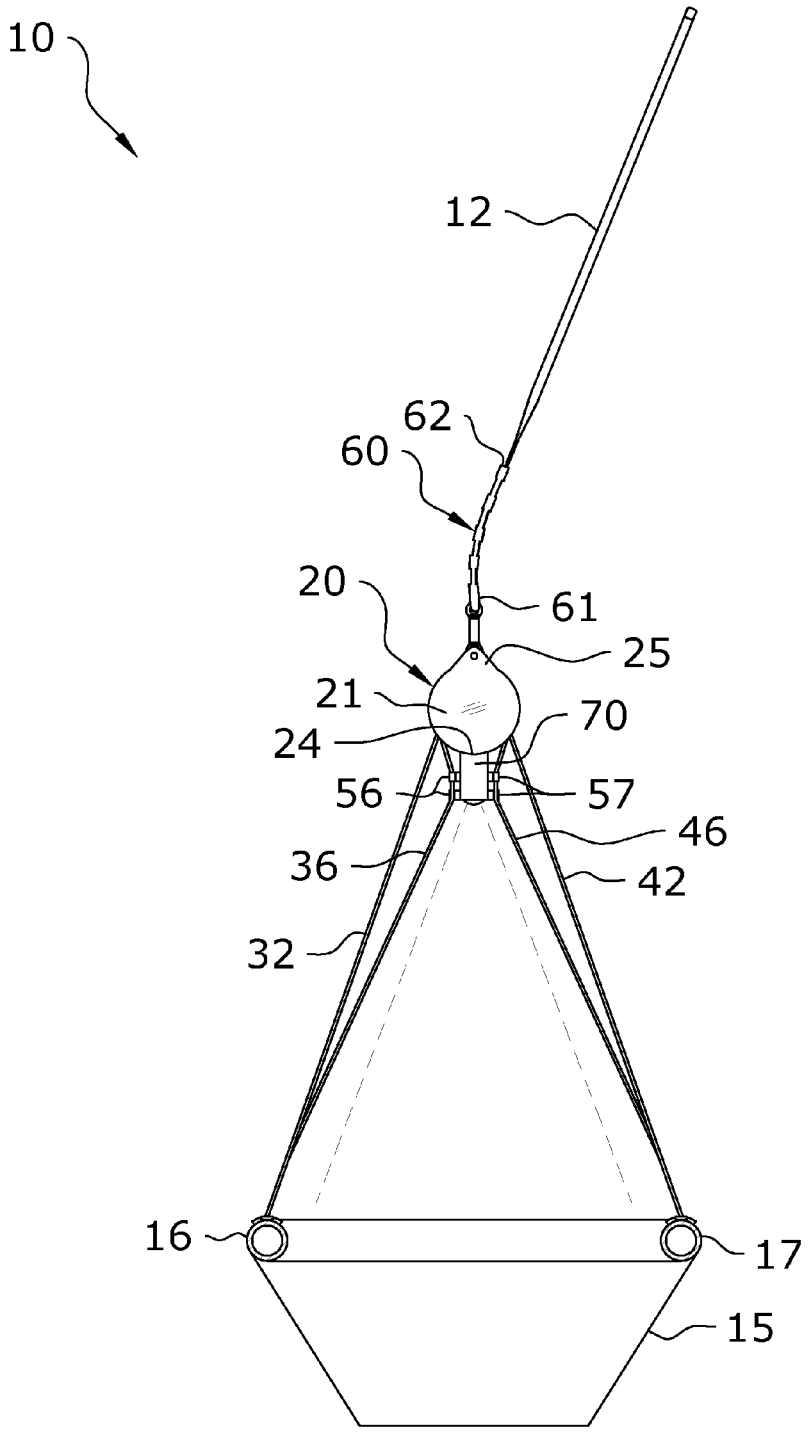
FIG. 11 is a top view of the present invention installed on a goal with the housing at a first position.
Figure 12:
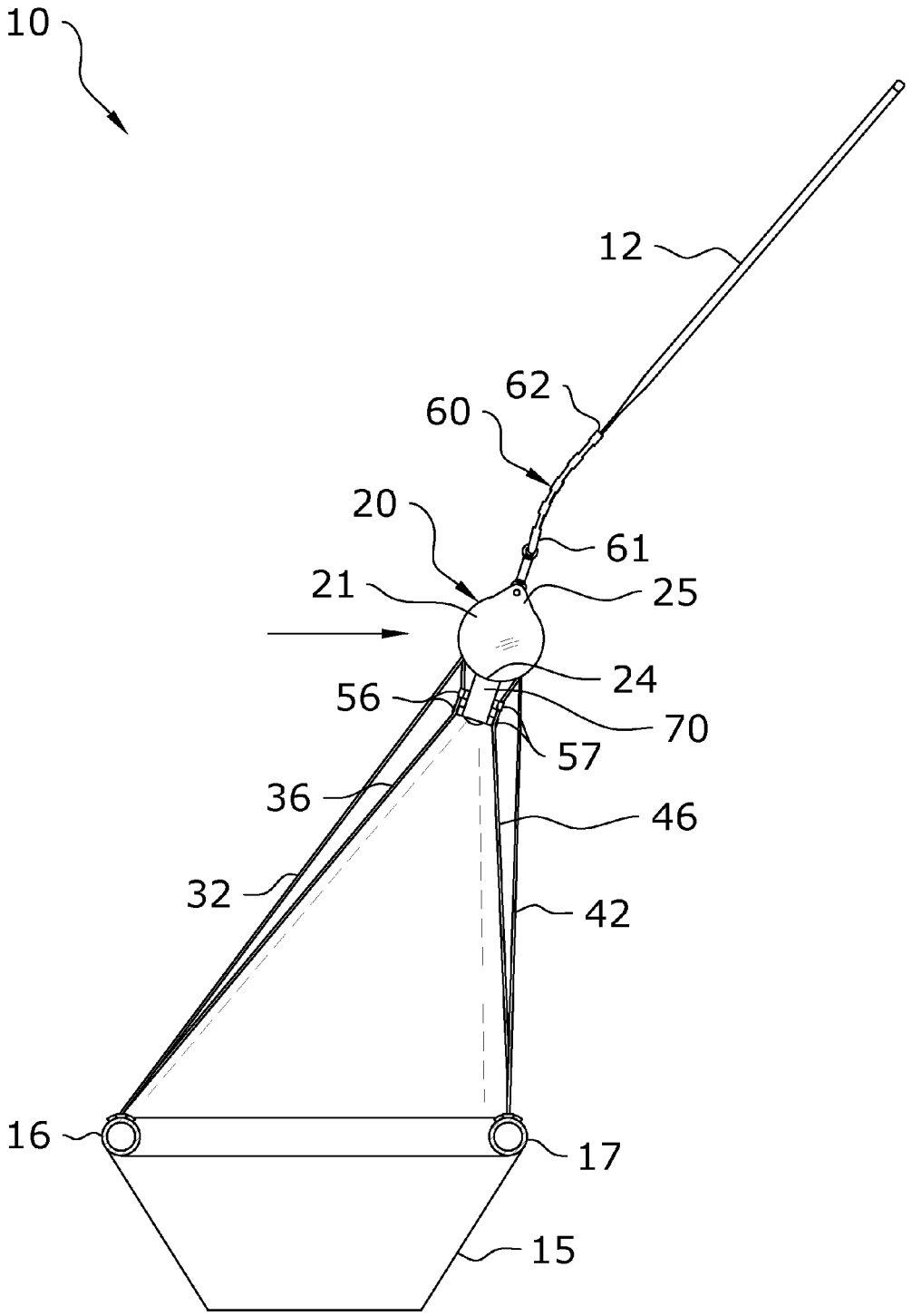
FIG. 12 is a top view of the present invention installed on a goal with the housing at a second position.
Figure 13:
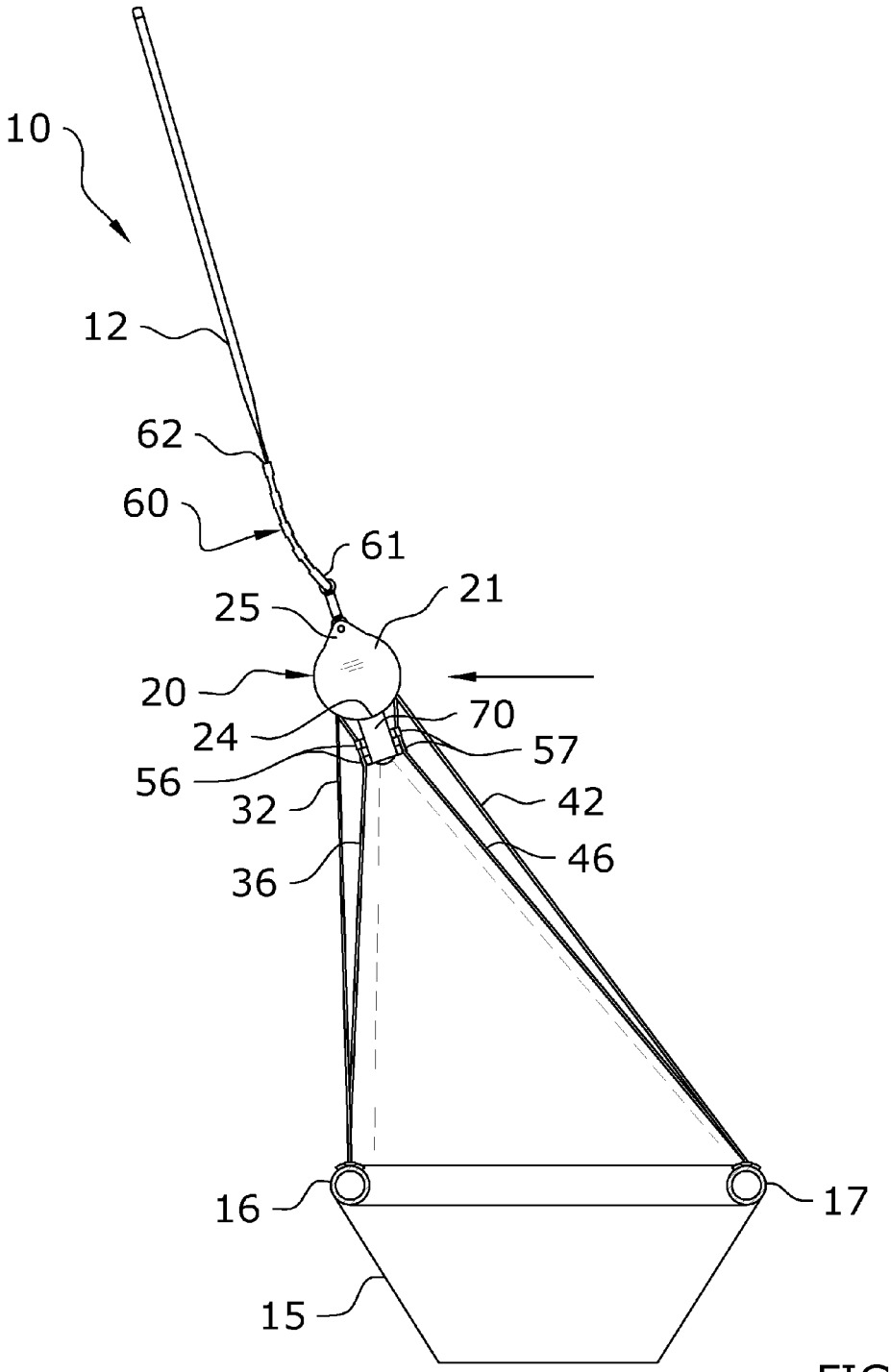
FIG. 13 is a top view of the present invention installed on a goal with the housing at a third position.

So attached, the cords 32, 36, 42, 46 will extend between the housing 20 and the goal 15 in such a manner as to delineate the likely area that a puck would travel if shot from a particular location. FIGS. 11-13 illustrate motion of the present invention from a plurality of angles, with the cords 32, 36, 42, 46 showing possible area of travel for a puck if shot. This will aid in visualization for both the potential shooter and the goalie to aid in improving hockey puck handling and goaltending skills.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A hockey practice system, comprising:

a housing including a front end and a rear end;

a plurality of cords retractably extending out of said front end of said housing, each of said plurality of cords being adapted to be removably secured to a goalpost;

a blade sleeve positioned on said rear end of said housing, said blade sleeve being adapted to be removably secured to a blade of a hockey stick.

2. The hockey practice system of claim 1, wherein said housing includes a plurality of reels.

3. The hockey practice system of claim 1, wherein each of said plurality of cords is wound around one of said plurality of reels.

4. The hockey practice system of claim 2, wherein said plurality of reels are stacked within said housing.

5. The hockey practice system of claim 4, wherein said plurality of reels include a first reel and a second reel positioned on top of said first reel.

6. The hockey practice system of claim 5, wherein said plurality of reels further include a third reel positioned on top of said second reel and a fourth reel positioned on top of said third reel.

7. The hockey practice system of claim 6, wherein said plurality of cords include a first upper cord wound around said fourth reel, a second upper cord wound around said third reel, a first lower cord wound around said second reel, and a second lower cord wound around said first reel.

8. The hockey practice system of claim 1, wherein said front end of said housing includes a camera mount.

9. The hockey practice system of claim 8, further comprising a camera secured to said camera mount.

10. The hockey practice system of claim 9, wherein said camera mount is hingedly secured to said housing.

11. A hockey practice system, comprising:

a housing including a front end and a rear end;

a plurality of cords retractably extending out of said front end of said housing, each of said plurality of cords being adapted to be removably secured to a goalpost;

a plurality of reels positioned within said housing, each of said cords being wound around one of said reels;

a camera mount extending from said housing; and a blade sleeve positioned on said rear end of said housing, said blade sleeve being adapted to be removably secured to a blade of a hockey stick.

12. The hockey practice system of claim 11, wherein said plurality of reels comprises four reels.

13. The hockey practice system of claim 12, wherein said plurality of cords comprises four cords.

14. The hockey practice system of claim 11, wherein said plurality of reels comprises a first reel and a second reel positioned on top of said first reel.

15. The hockey practice system of claim 14, wherein said plurality of reels further comprise a third reel positioned on top of said second reel and a fourth reel positioned on top of said third reel.

16. The hockey practice system of claim 15, wherein said first reel and said third reel are adapted to rotate in a first direction and wherein said second reel and said fourth reel are adapted to rotate in a second direction.

17. The hockey practice system of claim 16, wherein said plurality of cords include a first cord wound around said first reel, a second cord wound around said second reel, a third cord wound around said third reel, and a fourth cord wound around said fourth reel.

18. The hockey practice system of claim 11, wherein said camera mount is pivotably secured to said front end of said housing.

19. The hockey practice system of claim 18, further comprising a camera secured to said camera mount.

20. The hockey practice system of claim 19, wherein said camera comprises a video camera.

* * * * *